US005463401A

United States Patent [19]

Iwasaki

[11] Patent Number: 5,463,401

[45] Date of Patent: Oct. 31, 1995

[54] METHOD AND ARRANGEMENT OF POINTING AN ANTENNA BEAM TO A STATIONARY SATELLITE

[75] Inventor: Motoya Iwasaki, Tokyo, Japan

[73] Assignee: NEC Corporation, Japan

[21] Appl. No.: 990,673

[22] Filed: Dec. 14, 1992

[30] Foreign Application Priority Data

Dec. 12, 1991 [JP] Japan ..... 3-350653

[51] Int. Cl.[6] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 4,725,843 | 2/1988 | Suzuki et al. | 342/359 |
| 4,743,909 | 5/1988 | Nakamura et al. | 342/359 |
| 4,801,940 | 1/1989 | Ma et al. | 342/359 |
| 4,841,303 | 6/1989 | Anderson | 342/359 |
| 5,173,708 | 12/1992 | Suzuki et al. | 342/359 |
| 5,241,319 | 8/1993 | Shimizu | 342/359 |

*Primary Examiner*—Theodore M. Blum

*Attorney, Agent, or Firm*—Laff, Whitesel, Conte & Saret, Ltd.

[57] ABSTRACT

In order to initially point a directional antenna mounted on a mobile unit to a stationary satellite, the antenna is rotated one revolution in azimuth. While the antenna rotates, the maximum receive signal strength is detected together with the angular position of the antenna at which the maximum strength has been ascertained. Subsequently, the antenna is rotated to the angular position which has been determined in the preceding operation. If the angular position is determined correct (viz., the mobile unit is detected to be synchronized with the satellite), then the initial antenna beam orientation is terminated.

5 Claims, 2 Drawing Sheets

METHOD AND ARRANGEMENT OF POINTING AN ANTENNA BEAM TO A STATIONARY SATELLITE

BACKGROUND OF THE INVENTION

1. Field of the Invention

The present invention relates to a method and arrangement of implementing initial antenna beam pointing in a satellite mobile communications system, and more specifically to such a method and arrangement via which the initial antenna beam pointing is very rapidly carried out as compared with a known technique.

2. Description of the Prior Art

If a mobile unit such as an automobile, ship or the like, restarts communications with a stationary satellite, it is necessary to correctly direct the mobile unit mounted antenna beam to the satellite. After completing such an antenna beam point, a usual satellite tracking is implemented.

According to a known technique, the initial antenna beam pointing is carried out by rotating the antenna in azimuth at a somewhat slow speed so as to demodulate incoming signals and subsequently determine if the mobile unit is synchronized with the transmitter (viz., the satellite). A transmission bit rate in an ordinary satellite mobile communications system is as low as several thousands bps (bits per second), and the demodulation and the sync determination require several thousands bps. Accordingly, about one second is needed for completing one cycle of the demodulation and the syn determination. On the other hand, the antenna acquires the signals within a half-power beam width of about 10° (for example) in azimuth plane. This implies the antenna rotating speed should be set to 10°/sec. Thus, the antenna takes about 36 seconds until completing one revolution.

Consequently, the above mentioned prior art has encountered the problem in that it takes undesirably a long time until the antenna is correctly pointed to a satellite before restarting communications with the satellite.

SUMMARY OF THE INVENTION

It is an object of the present invention to provide a method of initially pointing a mobile unit mounted antenna to a stationary satellite in a shorter time duration as compared with the prior art technique.

Another object of the present invention is to provide an arrangement of initially pointing a mobile unit mounted antenna to a stationary satellite in a shorter time duration as compared with the prior art technique.

These objects are fulfilled by techniques wherein in order to initially point a directional antenna mounted on a mobile unit to a stationary satellite, the antenna is rotated one revolution in azimuth. While the antenna rotates, the maximum receive signal strength is detected together with the angular position of the antenna at which the maximum strength has been ascertained. Subsequently, the antenna is rotated to the angular position which has been determined in the preceding operation. If the angular position is determined correct (viz., the mobile unit is detected to be synchronized with the satellite), then the initial antenna beam orientation is terminated.

A first aspect of the present invention comes in a method of pointing a beam of a directional antenna, mounted on a mobile unit, to a stationary satellite, comprising the steps of:

(a) rotating the directional antenna one revolution in azimuth; (b) detecting maximum receive signal strength during the one revolution and acquiring an antenna angular position at which the maximum receive signal strength has been detected; (c) rotating the directional antenna to the antenna angular position; (d) determining if the mobile unit is synchronized with the stationary satellite using a signal received via the directional antenna at the antenna angular position; (e) terminating the antenna beam pointing if the mobile unit is detected synchronized with the stationary satellite at step (d); and (f) repeating steps (a) to (d) if the mobile unit is detected asynchronized with the stationary satellite at step (d).

A second aspect of the present invention comes in an arrangement of pointing a beam of a directional antenna, mounted on a mobile unit, to a stationary satellite, comprising: first means for controllably rotating the directional antenna in azimuth; second means for detecting maximum receive signal strength while the directional antenna is rotated one revolution under control of the first means, the second means acquiring an antenna angular position at which the maximum receive signal strength has been detected and the information of which is applied to the first means; and third means for determining if the mobile unit is synchronized with the stationary satellite at the antenna angular position, the third means applying the result determined to the first means, whereby the first means points the directional antenna beam to the stationary satellite at the antenna angular position.

BRIEF DESCRIPTION OF THE DRAWINGS

The features and advantages of the present invention will become more clearly appreciated from the following description taken in conjunction with the accompanying drawings in which like elements are denoted by like reference numerals and in which.

DETAILED DESCRIPTION OF THE PREFERRED EMBODIMENTS

Before turning to a preferred embodiment of the present invention it is deemed preferably to briefly describe a principle underlying the same.

In order to initially point a directional antenna mounted on a mobile unit to a stationary satellite, the antenna is rotated one revolution in azimuth. While the antenna rotates, the maximum receive signal strength is detected together with the angular position of the antenna at which the maximum strength has been ascertained. Subsequently, the antenna is directly rotated to the angular position which has been determined in the preceding operation. If the angular position is determined correct (viz., the mobile unit is detected to be synchronized with the satellite), then the initial antenna beam orientation is terminated. Thereafter, an usual satellite tracking is implemented.

Figure 1:
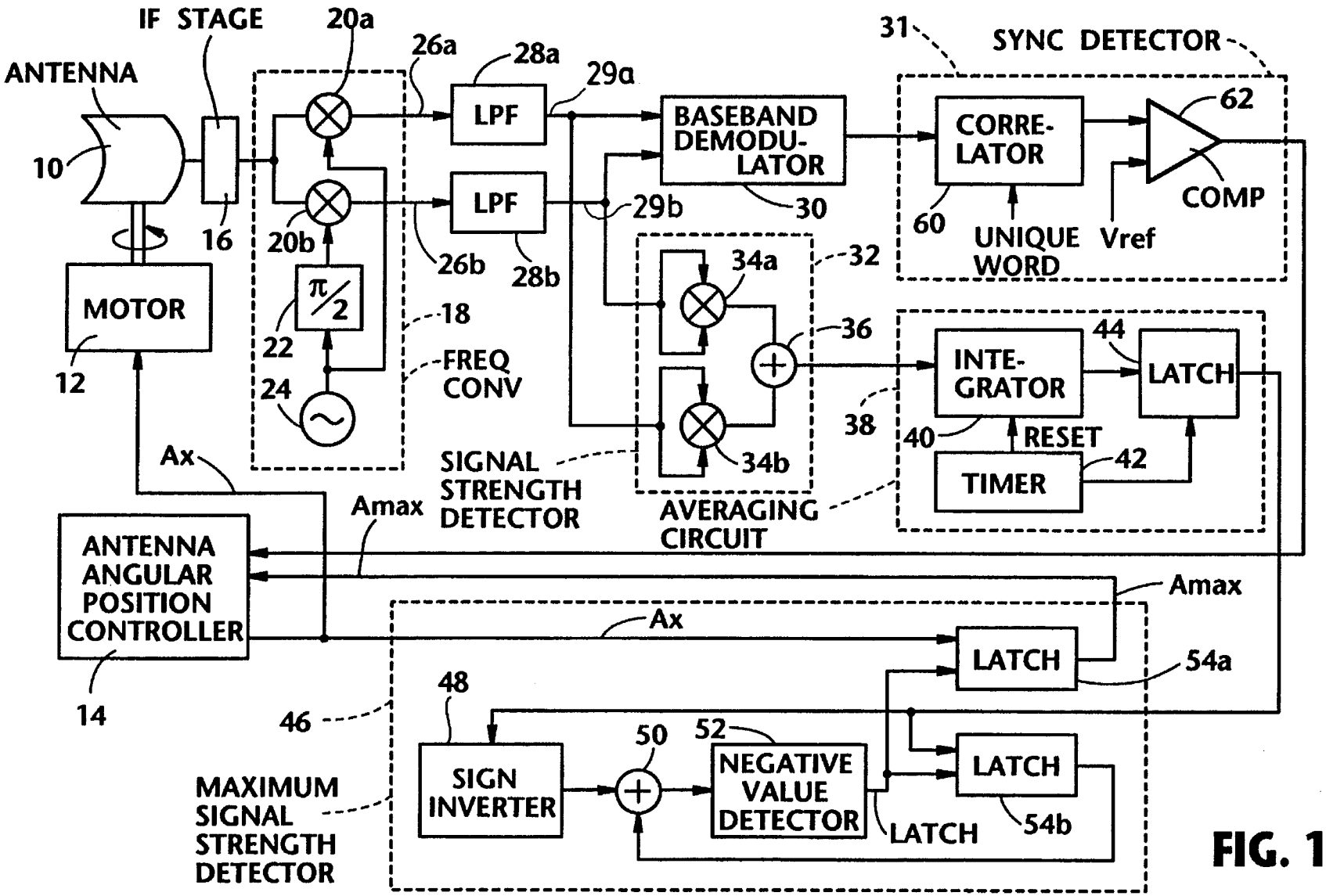
FIG. 1 is a block diagram showing one preferred embodiment of the present invention.

Reference is now made to FIG. 1, wherein one preferred embodiment of the present invention is shown in block diagram.

It is assumed that a fan beam formed by a directional antenna 10 has a pattern which is sharp in azimuth and broad in elevation. This renders the tracking of the stationary satellite in elevation plane unnecessary. The antenna 10 takes the form of a phased array antenna merely by way of example.

The directional antenna 10 is turned, by means of a motor 12, one revolution for the purpose of initially pointing antenna beam to a stationary satellite (not shown). The motor 12 rotates mechanically and angularly the antenna 10 in azimuth under the control of a control signal Ax outputted from an antenna angular position controller 14. The control signal Ax indicates the angular position of the antenna 10 relative to a reference position.

The antenna 10, while rotating, successively acquires PSK (for example) modulated incoming signals and applies same, via an IF (Intermediate Frequency) stage 16, to a frequency converter 18 which takes the form of a so-called quasi-coherent demodulator in this particular embodiment. The frequency converter 18 includes two multipliers 20*a*, 20*b*, a $\pi/2$ phase shifter 22, and a local oscillator 24. The multiplier 20*a* is directly coupled to the local oscillator 24, while the other multiplier 20*b* to the oscillator 24 via the phase shifter 22. The frequency converter 18 produces two baseband signals 26*a*, 26*b* which are respectively applied to low-pass filters (LPFs) 28*a*, 28*b*. The operation of the frequency converter 18 are well known in the art and hence further descriptions thereof will be omitted for the sake of brevity.

The baseband signals (denoted by 29*a* and 29*b*), outputted respectively from the LPFs 28*a*, 28*b*, are applied to a baseband demodulator 30 and also to a signal strength (or power) detector 32.

As mentioned above, one revolution of the antenna 10 in an azimuth plane is to detect the maximum receive signal strength, and hence only several hundreds bits acquired via the antenna 10 are sufficient for this purpose. This means that the antenna 10 can be rotated approximately 10 times faster as compared with the aforesaid prior art. These several hundreds bits, however, are insufficient for ascertaining synchronization of the mobile unit with a transmitter (viz., satellite) at a sync detector 31. The establishment of the synchronization will be referred to later.

The signal strength detector 32 is arranged to square the baseband signals 29*a*, 29*b* at square circuits 34*a*, 34*b*, respectively, and then adds the outputs thereof at an adder 36. The output of the signal strength detector 32 is applied to the next stage, viz., an averaging circuit 38 which includes an integrator 40, a timer 42 and a latch 44 and which generates integrated values at a predetermined time interval.

In more specific terms, it is assumed that the averaging circuit 38 is arranged to generate the integrated values every 300 bits which are sequentially applied thereto. Thus, if the transmission rate (viz., symbol rate) is 6000 bps, the integrated values are generated every 50 ms. In this instance, the timer 42 applies a latch pulse every 50 ms to the latch 44 for allowing same to catch the output of the integrator 40 and applies a reset pulse to the integrator 40 immediately after the issuance of the latch pulse.

The output of the averaging circuit 38 is applied to a maximum signal strength detector 46 which includes, a sign inverter 48, an adder 50, a negative value detector 52, and two latches 54*a*, 54*b*. When the FIG. 1 arrangement initially operates, the latch 54*b* retains zero value therein. When the averaging circuit 38 issues a first value (positive number) therefrom, the first value is rendered negative at the sign inverter 48. Thus, the negative detector 52 is responsive to the negative value and applies a latch pulse to the latches 54*a*, 54*b*. Therefore, the latch 54*b* holds the above mentioned first value therein, while the latch 54*a* retains the value of the control signal Ax which indicates the angular position of the antenna 10 which corresponds to the first value. If the second output of the averaging circuit 38 is greater than the first one, then the latch 54*b* in turn stores the second value while the latch 54*a* stores the control signal Ax which indicates the antenna pointing angle corresponding to the second output value.

When the directional antenna 10 has completed one revolution in azimuth, the latch 54*a* retains the value of the control signal Ax which indicates the angular position of the antenna 10 at which the incoming signal strength exhibits the maximum value. This angular position is denoted by Amax.

The antenna angular position controller 14 acquires the angular value Amax retained in the latch 54*a* and then locates the antenna at the angular value Amax. The baseband demodulator 30 demodulates the baseband signals applied from the frequency converter 18 via the LPFs 28*a*, 28*b*. The output of the baseband demodulator 30 is correlated with a unique word at a correlator 60 which forms part of the sync detector 31. The unique word has been stored in the mobile unit. The output of the correlator 60 is then applied to a comparator 62 and is compared thereat with a threshold Vref. If the output of the correlator 60 exceeds the threshold Vref, then the comparator 62 issues a logic 1 (for example) which indicates the synchronization has been established between the mobile unit equipped with the FIG. 1 arrangement and the transmitter (viz., the stationary satellite). In this instance the controller 14 is responsive to the establishment of synchronization (viz., logic 1) and terminates the initial antenna beam orientation.

In the case where the output of the correlator 60 fails to reach the threshold Vref, the controller 14 reiterates the above mentioned operations. That is, the controller 14 again rotates the antenna 10 one revolution in azimuth and detects the antenna angular position at which the receive signal strength exhibits the maximum value. Thereafter, the sync detector 31 checks to see if the mobile unit is synchronized with the satellite (i.e., transmitter) as discussed above.

The synchronization between the mobile unit and the satellite can usually be established at the antenna angular position at which the maximum receive signal strength is determined. Accordingly, the initial antenna beam pointing can effectively be achieved by rotating the antenna 10 one revolution (or two or three rotations at the worst) and then locating same at the angular position at which the maximum receive signal has been detected.

Figure 2:
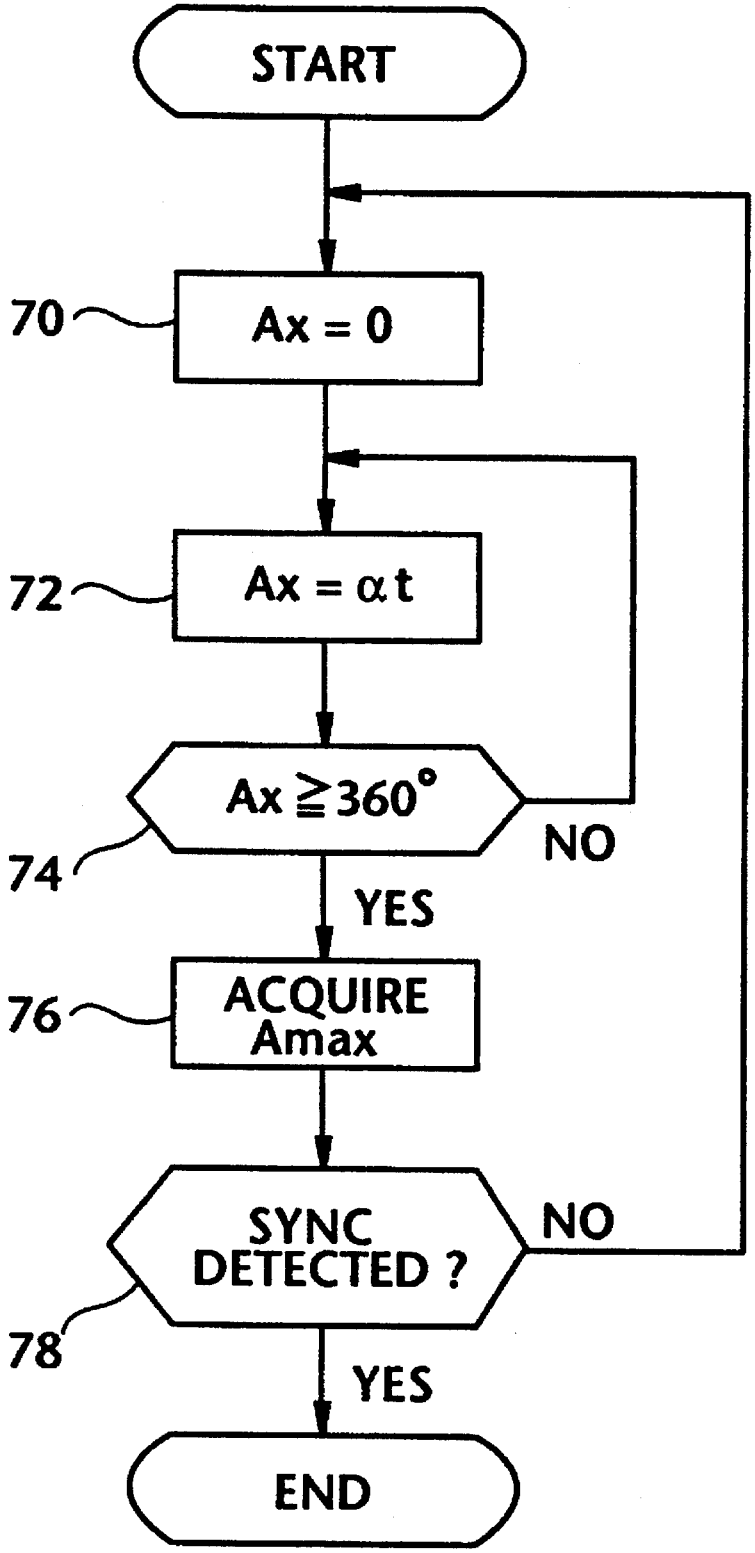
FIG. 2 is a flow chart which characterizes the operations of one block of FIG. 1.

FIG. 2 is a flow chart which characterizes the above mentioned operations. In FIG. 2, the antenna angular position control signal Ax is set to zero (viz., a reference angular position) at step 70. Subsequently, the antenna 10 is rotated at a predetermined angular rate defined by a predetermined coefficient $\alpha$ (step 72). The program checks to see if the control signal Ax does not reach 360°. If the answer is negative then the routine goes back to step 72. Otherwise (if positive), the controller 14 acquires the angular position signal Amax from the latch 54*a* at step 76. Following this, if the mobile unit is not synchronized with the satellite, the routine returns to step 70. On the other hand, if the result is affirmative at step 78, the initial antenna beam pointing is terminated.

As mentioned above, the one revolution of the antenna 10 can be made about 10 times faster as compared with the prior art. Further, the sync detection can be implemented in a very short time duration (one second for example). Therefore, it is understood that the present invention is noticeably advantageous as compared with the aforesaid prior art.

The present invention is applicable to the case where the antenna again requires the initial pointing to the satellite after communication breakdown due to a misalignment between the antenna and the satellite.

It will be understood that the above disclosure is representative of only one of the possible embodiments of the present invention and that the concept on which the invention is based is not specifically limited thereto.

What is claimed is:

1. A method of implementing a procedure for initially pointing an antenna beam of a directional antenna, mounted on a mobile unit, toward a stationary satellite, said antenna having a fan shaped pattern which makes an elevation searching for a satellite unnecessary, said method comprising the steps of:

(a) rotating said directional antenna through one complete revolution in azimuth;

(b) detecting a maximum strength of a received signal during said one complete revolution and acquiring an identification of an antenna angular position during said one complete revolution at which said maximum receive signal strength has been detected;

(c) rotating said directional antenna to said antenna angular position identified in step (b);

(d) determining whether said directional antenna is correctly pointed toward said stationary satellite by detecting a synchronization of a demodulated received signal on the basis of a correlation between a unique word demodulated from said received signal and a unique word stored in said mobile unit, said determination being made responsive to a signal received via said directional antenna at said antenna angular position;

(e) terminating the antenna beam pointing procedure in response to a detection that said directional antenna is correctly pointed toward said stationary satellite at step (d); and (f) repeating steps (a) to (d) in response to a detection that said directional antenna is not pointed toward said stationary satellite at step (d).

2. An arrangement for pointing a beam of a directional antenna, mounted on a mobile unit, toward a stationary satellite, said arrangement comprising:

first means for controllably rotating said directional antenna in azimuth;

second means for detecting an angular position where a received signal has a maximum strength while said directional antenna is being rotated through one complete revolution under control of said first means, said second means acquiring an antenna angular position at which said maximum received signal strength has been detected and applying information derived responsive to said detection to said first means, said first means then pointing said antenna in the direction in which said maximum signal strength was received; and third means for determining if said directional antenna is then pointed toward said stationary satellite at said antenna angular position in response to a detection of a synchronization of a demodulated received signal, said third means making said determination on a basis of a correlation between a unique word demodulated from said received signal and a unique word stored in said mobile unit, said third means applying the result which it determines to said first means, said first means pointing the directional antenna beam toward said stationary satellite at said angular antenna position in response to the result applied to it by said third means.

3. An arrangement as claimed in claim 2, wherein said first means includes:

an antenna rotating means operatively coupled to said directional antenna; and an antenna angular position controller operatively coupled to said second and third means.

4. An arrangement as claimed in claim 2, wherein said second means includes:

a signal strength detector which is supplied with baseband signals reproduced from signals received at said directional antenna and which detects receive signal strength;

an averaging circuit which follows said signal strength detector and produces average values of said receive signal strength at a predetermined time interval; and a maximum signal strength detector which is coupled to both said averaging circuit and said first means and detects said maximum receive signal strength while said directional antenna is rotated one revolution.

5. An arrangement as claimed in claim 4, wherein said third means includes:

a baseband demodulator which is arranged to receive and demodulate said baseband signals when said directional antenna is positioned at said angular antenna position; and a sync detector which is connected to said baseband demodulator and which generates a check signal indicating whether said directional antenna is pointing toward said stationary satellite at said angular antenna position, said sync detector applying the check signal to said first means.

* * * * *